US007424768B2

(12) United States Patent
Beruscha et al.

(10) Patent No.: US 7,424,768 B2
(45) Date of Patent: Sep. 16, 2008

(54) HANDLE FOR POWER TOOL

(75) Inventors: Michael Beruscha, Algonquin, IL (US); Daniel Williams, Chicago, IL (US); Timothy Baker, Roselle, IL (US); Francisco Lopez, Schaumburg, IL (US); David Clarke, Chicago, IL (US); Brad Baber, Arlington Heights, IL (US); Joshua Barhitte, Chicago, IL (US)

(73) Assignees: Credo Technology Corporation, Broadview, IL (US); Robert Bosch GmbH, Stuttgart (DE)

( * ) Notice: Subject to any disclaimer, the term of this patent is extended or adjusted under 35 U.S.C. 154(b) by 202 days.

(21) Appl. No.: 11/228,083

(22) Filed: Sep. 16, 2005

(65) Prior Publication Data

US 2007/0062005 A1 Mar. 22, 2007

(51) Int. Cl.
*A45C 13/26* (2006.01)

(52) U.S. Cl. ..... 16/422; 408/124

(58) Field of Classification Search ..... 16/422, 16/444; 173/213, 216, 217; 409/181, 182; 408/124; 81/177.1, 177.4, 177.85, 489, 490; 294/16, 33, 32, 29, 27.1, 165, 170; 312/332.1
See application file for complete search history.

(56) References Cited

U.S. PATENT DOCUMENTS

| | | | | |
|---|---|---|---|---|
| 1,751,781 | A | 3/1930 | Weiss | |
| 2,211,216 | A | 8/1940 | Oster | |
| 2,702,098 | A | 2/1955 | Staak | |
| 2,738,192 | A * | 3/1956 | Wells | 473/127 |
| 2,897,302 | A | 7/1959 | Godfrey et al. | |
| 2,996,299 | A * | 8/1961 | Showers | 473/127 |
| 3,011,851 | A * | 12/1961 | Verga et al. | 312/332.1 |
| 3,076,223 | A * | 2/1963 | Reichold | 16/425 |
| 3,190,713 | A * | 6/1965 | Vander Sande et al. | 312/332.1 |
| 3,193,342 | A * | 7/1965 | Sauter | 312/332.1 |
| 3,228,740 | A * | 1/1966 | Lundell | 312/332.1 |
| 3,313,586 | A * | 4/1967 | McClintock | 312/332.1 |
| 3,511,947 | A | 5/1970 | Eikermann et al. | |
| 3,533,655 | A | 10/1970 | Harley | |

(Continued)

FOREIGN PATENT DOCUMENTS

FR 2234882 1/1975

(Continued)

OTHER PUBLICATIONS

International Search Report and Written Opinion for PCT/US2006/034911; date of mailing Dec. 20, 2006, 10 pages.

(Continued)

*Primary Examiner*—Chuck y. Mah
(74) *Attorney, Agent, or Firm*—Foley & Lardner LLP

(57) ABSTRACT

A power tool having a handle includes a first member configured to selectively engage a housing of a power tool and a second member provided adjacent the first member and movable between a first position and a second position. A portion of the second member restricts movement of the first member when the second member is in the first position and the portion of the second member does not restrict movement of the first member when the second member is in the second position such that the first member may be moved to disengage the power tool housing.

26 Claims, 6 Drawing Sheets

U.S. PATENT DOCUMENTS

| | | | | |
|---|---|---|---|---|
| 3,565,429 | A * | 2/1971 | Williams | 473/127 |
| 3,575,482 | A * | 4/1971 | MacMaster et al. | 312/332.1 |
| 3,588,411 | A * | 6/1971 | Milcoy | 307/126 |
| 3,767,876 | A | 10/1973 | Batson | |
| 3,872,951 | A | 3/1975 | Hastings, Jr. | |
| 3,899,852 | A | 8/1975 | Batson | |
| 4,061,126 | A | 12/1977 | Schlangen | |
| 4,133,128 | A | 1/1979 | Brush | |
| 4,280,026 | A | 7/1981 | Alessio | |
| 4,489,525 | A | 12/1984 | Heck | |
| 4,520,256 | A | 5/1985 | Doyle | |
| 4,577,365 | A | 3/1986 | Yuen | |
| 4,577,367 | A | 3/1986 | Durand | |
| 4,735,020 | A | 4/1988 | Schulz et al. | |
| 4,932,294 | A | 6/1990 | Chang | |
| 4,934,223 | A | 6/1990 | Wong | |
| 5,022,188 | A | 6/1991 | Borst | |
| 5,074,081 | A | 12/1991 | Beth et al. | |
| 5,098,235 | A | 3/1992 | Svetlik et al. | |
| 5,143,490 | A | 9/1992 | Kopras | |
| 5,191,968 | A | 3/1993 | McCurry | |
| 5,208,735 | A * | 5/1993 | Twachtmann et al. | 361/725 |
| 5,323,823 | A | 6/1994 | Kopras | |
| 5,346,342 | A | 9/1994 | Winchester | |
| 5,369,236 | A | 11/1994 | Nickels, Jr. | |
| 5,445,479 | A | 8/1995 | Hillinger | |
| 5,558,570 | A | 9/1996 | Nakamura et al. | |
| 5,810,525 | A | 9/1998 | Ector, Sr. | |
| 5,813,805 | A | 9/1998 | Kopras | |
| 5,819,913 | A | 10/1998 | Reiter | |
| 5,902,080 | A | 5/1999 | Kopras | |
| 6,048,260 | A | 4/2000 | Kopras | |
| 6,152,639 | A | 11/2000 | Hsu | |
| 6,169,258 | B1 | 1/2001 | Rodney et al. | |
| D439,122 | S | 3/2001 | Adler et al. | |
| D439,484 | S | 3/2001 | Adler et al. | |
| 6,196,093 | B1 | 3/2001 | Hu | |
| 6,327,781 | B1 | 12/2001 | Sinclair et al. | |
| 6,364,580 | B1 | 4/2002 | Dils et al. | |
| D458,333 | S | 6/2002 | Power | |
| 6,443,675 | B1 | 9/2002 | Kopras et al. | |
| 6,443,676 | B1 | 9/2002 | Kopras | |
| 6,454,427 | B1 | 9/2002 | Chen | |
| D465,393 | S | 11/2002 | Kopras et al. | |
| D465,712 | S | 11/2002 | Kopras et al. | |
| D466,775 | S | 12/2002 | Kopras et al. | |
| 6,488,451 | B1 | 12/2002 | Hartman | |
| D473,770 | S | 4/2003 | Kopras et al. | |
| 6,729,480 | B1 | 5/2004 | Blake | |
| 6,754,935 | B2 | 6/2004 | Pozgay et al. | |
| 6,786,685 | B2 | 9/2004 | Schaub et al. | |
| 6,802,108 | B2 | 10/2004 | Haselby et al. | |
| 6,803,683 | B2 | 10/2004 | Bone et al. | |
| 6,814,157 | B2 | 11/2004 | Maras | |
| 6,854,938 | B2 | 2/2005 | Kopras et al. | |
| 6,880,281 | B1 | 4/2005 | Orr | |
| 6,886,643 | B2 | 5/2005 | Riley et al. | |
| 6,890,135 | B2 | 5/2005 | Kopras et al. | |
| 6,918,720 | B2 | 7/2005 | Kopras et al. | |
| 6,926,477 | B2 | 8/2005 | Allemann et al. | |
| 2003/0088941 | A1 | 5/2003 | Rotondi | |
| 2003/0221292 | A1 | 12/2003 | Pozgay et al. | |
| 2004/0187322 | A2 | 9/2004 | Bednar et al. | |
| 2004/0191021 | A1 | 9/2004 | Breitenmoser | |
| 2004/0206649 | A1 | 10/2004 | Chen | |
| 2005/0081364 | A1 | 4/2005 | Kopras et al. | |
| 2005/0097759 | A1 | 5/2005 | Igarashi | |

FOREIGN PATENT DOCUMENTS

| | | |
|---|---|---|
| SU | 397449 | 6/1924 |
| WO | WO 01/19228 A1 | 3/2001 |

OTHER PUBLICATIONS

Cutting tool of a type understood to be commercially available from Sears, Roebuck and Co. (two photographs, one sheet).

Owner's manual for "Craftsman All-In-One Cutting Tool," understood to be commercially available from Sears, Roebuck and Co., dated Jul. 21, 2003 (three sheets).

US 6,385,032, 12/2004, Pozgay et al. (withdrawn)

* cited by examiner

HANDLE FOR POWER TOOL

BACKGROUND

The present invention relates generally to the field of power tools. More specifically, the present invention relates to hand-held power tools that include handles that may be selectively attached to and detached from the tools.

Hand-held power tools generally include a housing and a motor contained within the housing. The motor is configured to move a tool bit or other cutting accessory at high speeds to form cuts in a workpiece (e.g., a piece of wood, drywall, tile, etc.). For example, a hand-held rotary cutting tool such as that disclosed in U.S. Pat. Nos. 5,813,805 and 6,443,675 to Kopras et al. (the disclosures of which are incorporated by reference herein in their entirety) is configured to rotate a helical or spiral cutting tool bit that includes a sharp cutting edge wrapped in a helix around the longitudinal axis of the bit. According to this example, the tool is configured to allow the formation of cuts in a workpiece by moving the tool in a direction perpendicular to the axis of rotation of the bit (i.e., the tool is arranged normal to the workpiece surface and moved parallel to the surface of the workpiece to allow the edges of the bit to remove material from the workpiece).

It may be desirable to provide a handle that can be selectively attached to and detached from a power tool. The handle may act to provide enhanced comfort and control during use of the power tool and may be removed from the tool to allow attachment of other components to the tool (e.g., a "jigsaw" style handle, a soft fabric handle, a plunge router or depth guide, etc.).

Due to the manner in which power tools such as rotary cutting tools are used, it would be desirable to provide handles that remain attached to the power tool unless and until they are intentionally removed by an operator of the tool. For example, it would be advantageous for the handle to remain attached to the tool despite various forces which may be present during use of the tool (e.g., forces resulting from the rotation of the tool bit and/or cutting of a workpiece, etc.). It would also be advantageous for the handle to remain attached to the tool in the event that the power tool is dropped or struck by an object.

It would be advantageous to provide an improved power tool having a detachable handle that may be securely coupled to the power tool in a relatively simple and efficient manner. It would also be advantageous to provide a mechanism for selectively attaching a handle to a power tool that resists detachment of the handle during use of the power tool. It would be desirable to provide a power tool having any one or more of these or other advantageous features as may be apparent to those reviewing this disclosure.

SUMMARY

An exemplary embodiment of the invention relates to a power tool having a handle. The handle includes a first member configured to selectively engage a housing of a power tool and a second member provided adjacent the first member and movable between a first position and a second position. A portion of the second member restricts movement of the first member when the second member is in the first position and the portion of the second member does not restrict movement of the first member when the second member is in the second position such that the first member may be moved to disengage the power tool housing.

Another exemplary embodiment of the invention relates to a power tool having a detachable handle. The power tool includes a mechanism for selectively attaching the handle to a power tool. The mechanism includes a first movable member and a second movable member. The first movable member is configured to engage a portion of the power tool when the handle is coupled to the power tool. The second movable member prevents disengagement of the first movable member from the power tool when the second movable member is in a first position and allows disengagement of the first movable member from the power tool when the second movable member is moved to a second position.

Another exemplary embodiment of the invention relates to a handle for a power tool that may be selectively attached to and detached from the power tool. The handle includes means for coupling the handle to the power tool that is configured for selective engagement with feature of the power tool. The handle also includes means for restricting movement of the means for means for coupling. The means for restricting is configured for movement between a first position in which movement of the means for coupling is restricted and a second position in which movement of the means for coupling is not restricted. The handle may be decoupled from the power tool when the means for restricting movement is in the second position and the handle may not be decoupled from the power tool when the means for restricting movement is in the first position.

DETAILED DESCRIPTION OF EXEMPLARY EMBODIMENTS

Figure 1:
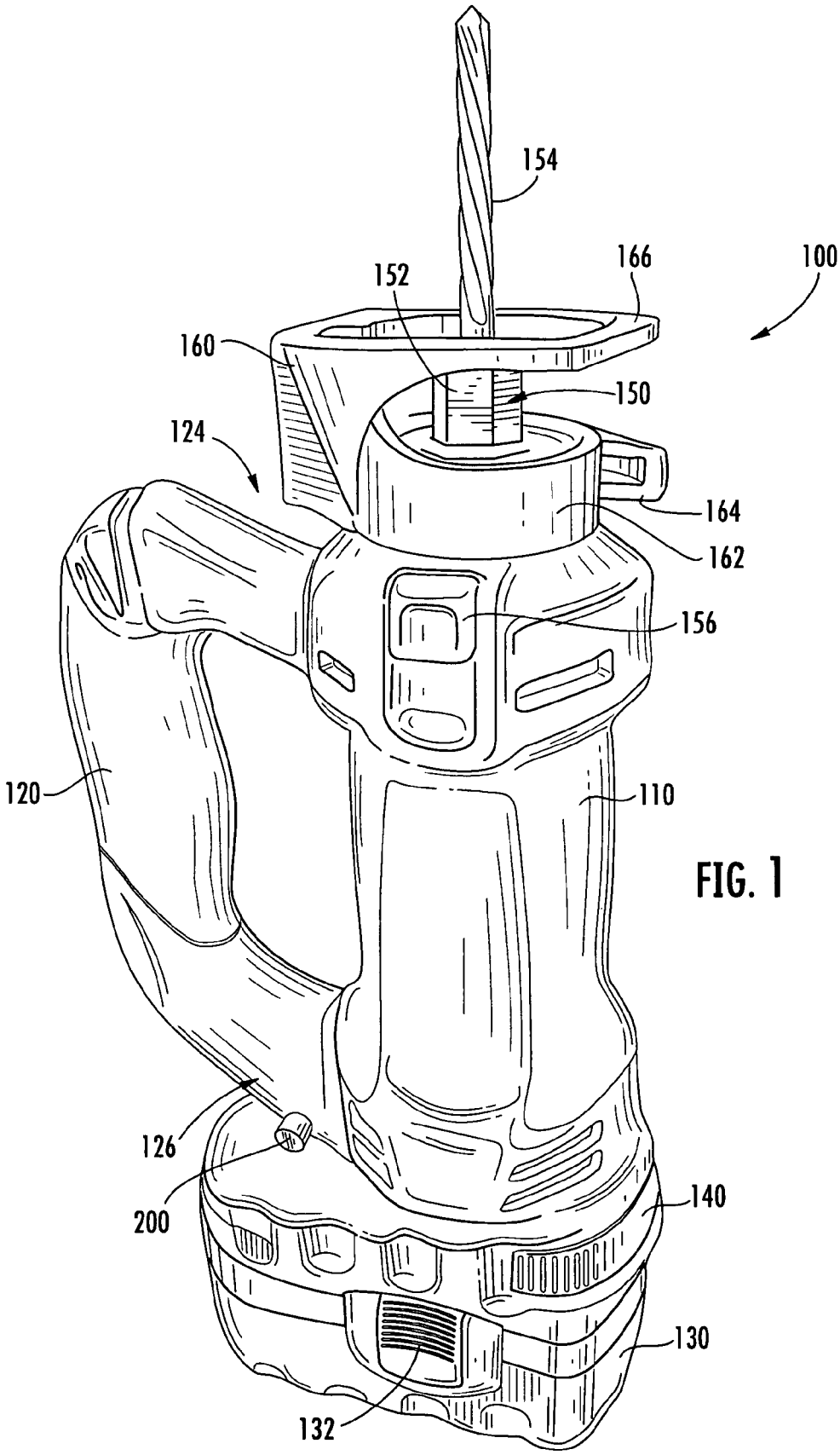
FIG. 1 is a perspective view of a hand-held power tool according to an exemplary embodiment.
Figure 2:
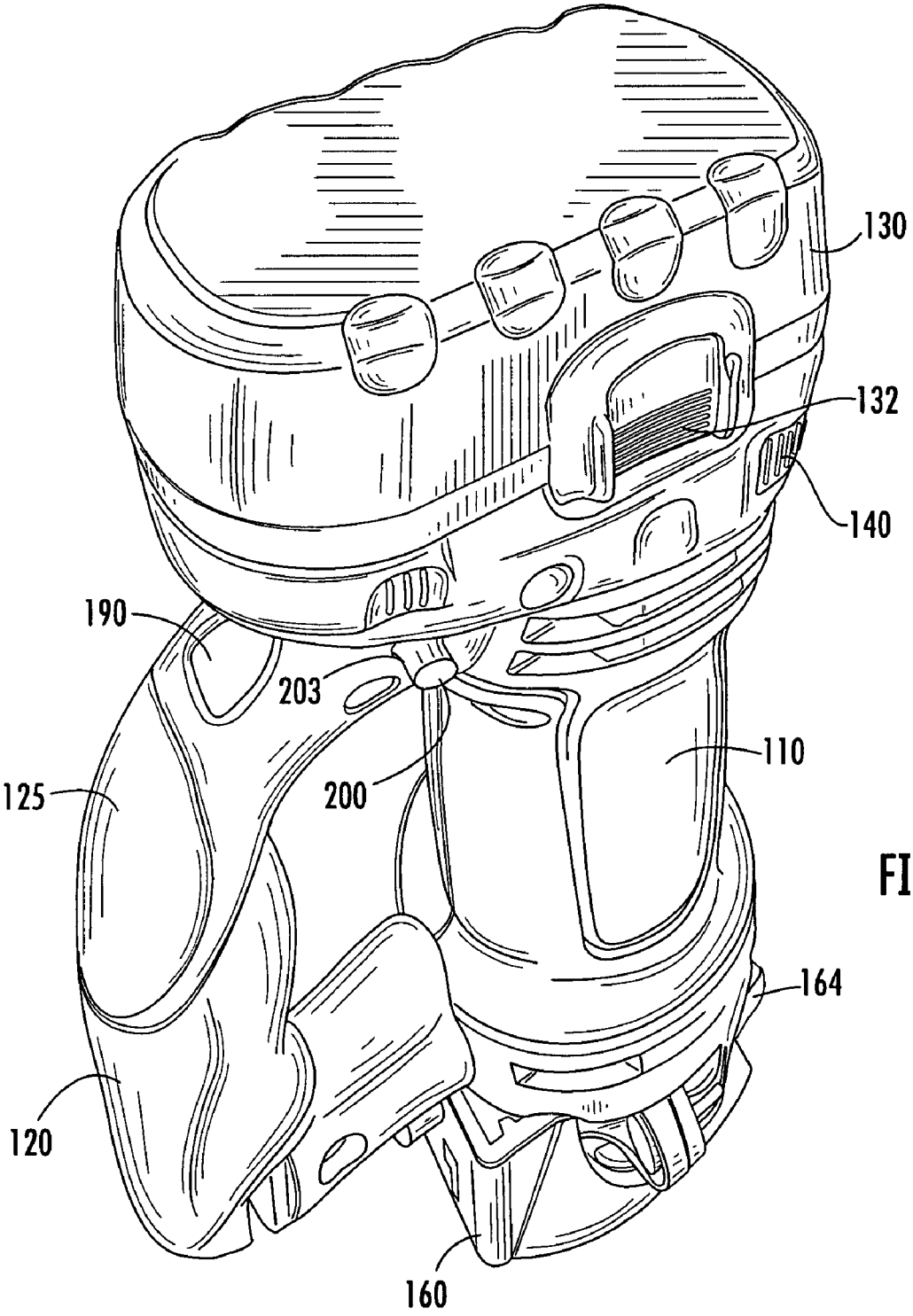
FIG. 2 is another perspective view of the hand-held power tool shown in FIG. 1.

A hand-held rotary power tool 100 in the form of a rotary cutting tool is shown generally in FIGS. 1 and 2. It should be understood that, although the present invention will be described in detail herein with reference to the exemplary embodiment of a rotary cutting tool 100 shown in FIGS. 1 and 2, the present invention may be applied to, and find utility in, other types of hand-held power tools as well (e.g., drills, saws, routers, etc.), and therefore, the scope of this invention is not limited to application in a rotary cutting tool 100.

The tool 100 includes a housing or casing 110 to which a handle 120 is attached. The housing 110 is made of an electrically insulating material such as hard plastic according to an exemplary embodiment. The housing 110 is generally cylindrical in shape, and may be formed as two or more molded pieces which are joined together to form the housing 110 in a conventional manner, such as using fasteners, an adhesive, welding, or a combination thereof.

A motor (not visible in FIGS. 1 and 2) is enclosed within the housing 110. According to an exemplary embodiment, the motor receives electrical power from a battery pack 130 selectively coupled to the power tool at an end thereof. A member or element 132 is provided to allow the battery pack 130 to be removed when the member 132 is depressed. According to an exemplary embodiment, the battery pack 130 includes one or more rechargeable batteries and has a fully charged voltage of between approximately 12 and 24 volts. According to a particular exemplary embodiment, the battery pack has a fully charged voltage of approximately 18.6 volts. The battery pack 130 may include any suitable type of batteries, such as nickel-metal hydride or lithium-ion batteries. It should be noted that while the exemplary embodiments described herein are illustrated as having a battery pack, the detachable handle and related mechanisms may also be utilized in conjunction with corded power tools (e.g., corded rotary cutting tools, etc.).

The motor is turned on and off by a power on/off switch 140. According to an exemplary embodiment, the switch 140 is pulled away from the housing 110 to activate the motor. The motor may be configured to operate at a single speed (e.g., a speed between approximately 15,000 and 30,000 rpm) or a number of speeds (e.g., speeds of 15,000 rpm, 20,000 rpm, and 30,000 rpm). In a case where the motor is capable of operating at multiple speeds, the switch may include multiple positions corresponding to the desired motor speed.

The motor of the tool 100 drives a motor shaft to which a device or mechanism 150 is coupled for securing a cutting accessory (e.g., a helical cutting tool bit or other accessory) to the motor shaft. As shown in FIG. 1, the device 150 includes a collet (not shown) and a collet nut 152 for securing a tool bit 154 to the motor shaft of the tool 100. According to an exemplary embodiment, the tool bit 154 includes a cutting edge wrapped around the axis of the bit in a helix or spiral. This cutting edge is designed such that the tool bit 154, when rotated at high speed, will cut through a workpiece in a direction substantially perpendicular to the axis of the bit.

To secure the tool bit 154 to the motor shaft, a shank of the bit is inserted into a central aperture of the collet, after which the collet nut 152 is tightened. A shaft lock 156 is used to prevent rotation of the motor shaft when the collet nut 152 is being loosened and tightened. As the collet nut 152 is tightened down on the threaded end of the shaft, the collet is compressed within the collet nut 152 between a partially closed end of the collet nut 152 and the shaft. The collet is slotted and has tapered ends such that when the collet is compressed between the collet nut 152 and the shaft, the collet is compressed radially, causing the central aperture of the collet to close tightly around the shank of the tool bit. To remove the bit from the motor shaft, the collet nut 152 is loosened until the bit can be removed easily from the central aperture of the collet.

To set the depth of cut to be made by the tool 100, an adjustable depth guide assembly 160 may be provided. The depth guide 160 is attached to the housing 110 adjacent the location where the motor shaft emerges from the housing 110.

As shown in FIG. 1, a depth guide bracket 162 is selectively attachable to the housing 110, and may be attached to the housing 110 in any conventional manner. For example, the depth guide bracket 162 may be formed to have a split collar structure and a cam closing mechanism 164 (e.g., an over-center latch) which is operated to close the collar tight around the end of the tool housing 110, and which may be operated to loosen the collar to remove the bracket 162 from the housing 110.

The depth of cut of the power tool 100 may be set by moving an extending portion 166 of the depth guide 160 in a direction along the longitudinal axis of the tool bit 154. A locking mechanism may then be used to lock the extending portion 166 in a fixed position relative to the bracket 162 to securely fix the depth guide 160 in place. The locking mechanism may be implemented as a cam lever, as a threaded nut or a screw, or as any other suitable type of device or mechanism.

FIGS. 3-9 illustrate features of the handle 120 according to an exemplary embodiment. According to an exemplary embodiment, the handle 120 may be selectively attached to and detached from the housing 110 of the power tool 100. It may be desirable that the handle 120 be detached for some applications (e.g., to couple other attachments to the power tool, etc.). Thus, it is desirable to provide both for securely attaching the handle 120 to the tool 100 when needed and for easily detaching the handle 120 from the tool 100 when its use would interfere with operation of the tool 100.

The handle 120 has a generally "C" shaped configuration and includes a gripping surface 122 extending between a first end 124 and a second end 126 of the handle 120. The gripping surface 122 may be contoured in shape so that the handle 120 may be grasped comfortably in the hand of an operator of the tool 100. The gripping surface 122 is aligned substantially parallel with the central longitudinal axis of the tool housing 110 and the longitudinal axis of the tool bit 154. It should be understood that the term "substantially parallel" as used in this context throughout this specification means "more parallel than not." Therefore, the angle of the handle gripping surface 122 with respect to the axis of the tool 100 may be varied from exactly parallel by several degrees. The handle 120 and the gripping surface 122 may be made of a semi-rigid plastic material or any other suitable material. According to a particular exemplary embodiment, a portion of the gripping surface 122 includes an elastomeric (e.g., rubber) material provided on a surface thereof to promote better grip by a user of the tool 100.

Figure 3:
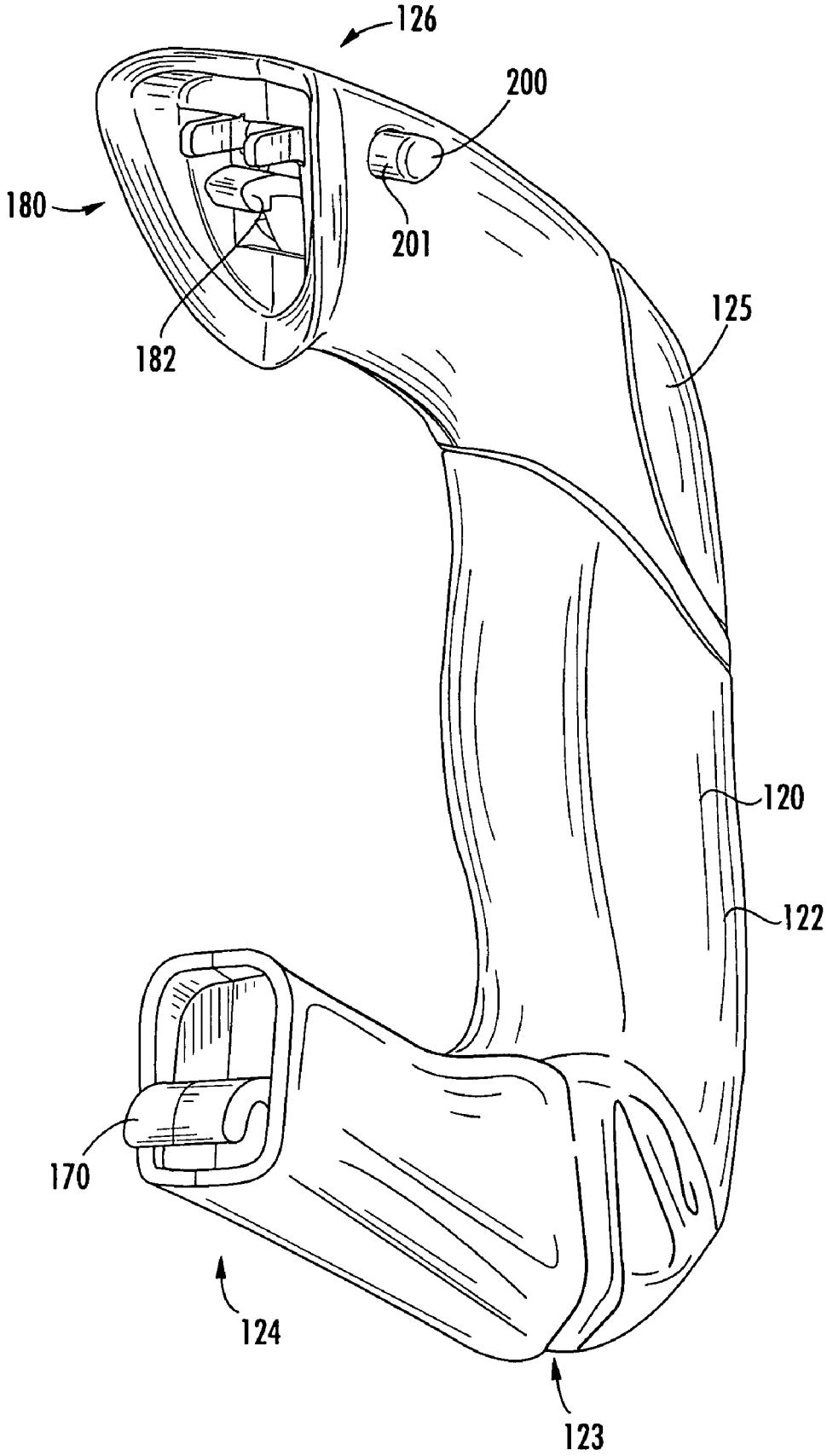
FIG. 3 is a perspective view of a detachable handle for the hand-held power tool shown in FIG. 1 according to an exemplary embodiment.

As shown in FIG. 3, the handle 120 includes a member or element 170 in the form of an extension or protrusion (e.g., a hook) that extends from the first end 124 of the handle 120 for securing the first end 124 of the handle 120 to the housing 110 of the tool 100. The member 170 is relatively rigid or fixed and may be integrally formed with the handle 120. For example, the member 170 may be molded as part of the handle 120 during a molding process in which a polymeric material is molded to form the handle 120.

The member 170 is configured for insertion into an aperture or opening in the form of a slot or similar structure (not shown) provided in the housing 110 of the tool 100 when the handle 120 is attached thereto. According to an exemplary embodiment, the member 170 is configured to engage a feature (e.g., a ledge, lip, edge, etc.) provided in the housing 110. For example, according to a particular exemplary embodiment, the member is configured to engage an inner surface of a wall of the housing around the opening and/or the edge of the opening itself. It should be noted that the size, shape, and configuration of the member 170 may differ from that shown in FIG. 3 according to various other exemplary embodiments.

As shown in FIGS. 3-9, the handle 120 also includes a system or mechanism 180 for selectively securing the second end 126 of the handle 120 to the housing 110 of the tool 100. The mechanism 180 includes a movable member or element 182 that includes an end 184 having a feature 186 (FIG. 4) such as a hook, lip, or edge that is configured to engage a feature provided in the housing 110 of the power tool 100. Similar to the member 170, the end 184 may be inserted into an aperture or opening formed in the housing 110 and configured such that when the handle 120 is secured to the housing 110, the feature 186 engages the housing or a feature provided therein.

Figure 7:
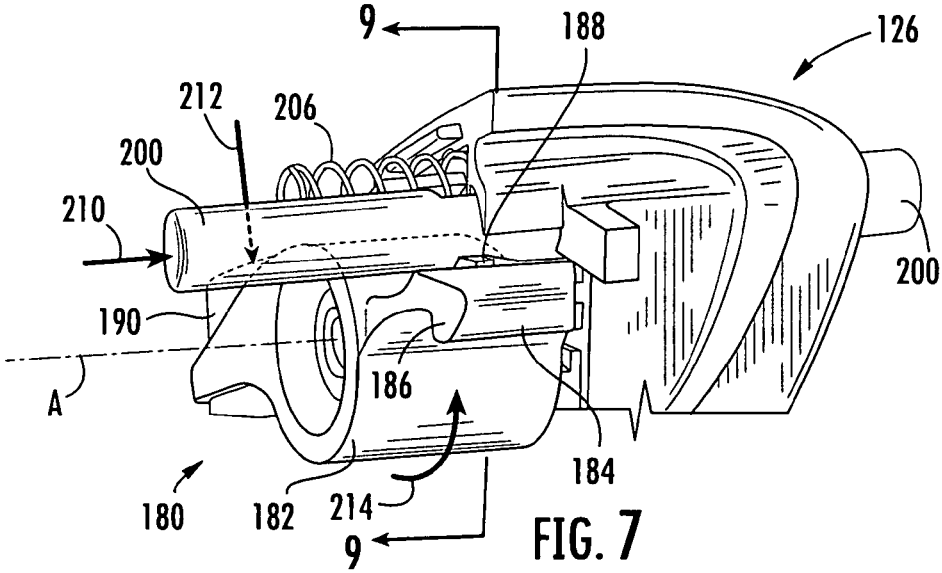
FIG. 7 is a partial cutaway perspective view of a portion of the detachable handle shown in FIG. 3 illustrating a handle attachment mechanism according to an exemplary embodiment in an unlocked position.

The movable member 182 is configured for pivoting or rotating about an axis (shown as line A in FIGS. 4 and 7) and is preferably formed of a metal such as die cast zinc according to an exemplary embodiment (other rigid materials, such as rigid polymeric materials, may be used according to other exemplary embodiments). A second end 189 of the movable member 182 opposite the first end 184 is biased upward by a spring 192 provided in the handle 120. A surface or button 190 coupled or attached to the second end 189 of the movable member 182 is accessible through an aperture or opening 127 provided in the handle 120. An operator of the handle may depress the button 190 with a thumb to cause the movable member 182 to rotate about line A such that the first end 184 of the movable member 182 moves upward when the second end 189 of the movable member 182 is forced downward as shown in FIG. 7. As shown in FIG. 7, a force downward on the button 190 is represented by an arrow 212, which causes rotation of the movable member 182 as indicated by an arrow 214.

In this manner, the movable member 182 may be pivoted or rotated about the line A such that the first end 184 of the movable member 182 may disengage a feature provided in the housing 110 of the power tool 100. Thus, by depressing the button 190 to cause the movable member 182 to rotate and move the first end 184 upward and away from the housing 110 of the tool 100, the second end 126 of the handle 120 may be disengaged from the tool 100. Once the second end 126 of the handle 120 is no longer engaged with the housing 110, the handle 120 may be rotated about the member 170 and the first end 124 may be removed from the housing 110.

A member 200 (FIG. 5) is provided to restrict movement of the movable member 182, for example, when the handle 120 is attached or coupled to the tool 100. The member 200 is biased by a spring 206 such that it is centered laterally within the second end 126 of the handle 120. As shown in FIGS. 1 and 2, ends 201 and 203 of the member 200 protrude from opposite sides of the handle 120 when the member 200 is provided in its rest position according to an exemplary embodiment. According to another exemplary embodiment, only one of the ends may protrude from the handle when the member is provided in its rest position.

The member 200 is provided for restricting movement of the movable member 182 when the handle 120 is attached to the tool 100 and is preferably formed of a metal such as die cast zinc according to an exemplary embodiment (other rigid materials, such as rigid polymeric materials, may be used according to other exemplary embodiments). The movable member 182 includes a protrusion or extension 188 (FIG. 6) that may abut or contact a portion 202 of the member 200 to prevent free rotation of the movable member 182. The portion 202 of the member 200 extends downward toward the protrusion 188 on the movable member 182 when the member 200 is in its rest position. According to an exemplary embodiment, the member 200 is in its rest position when the handle 120 is coupled to the tool 100. Due to the interaction between the protrusion 188 and the portion 202 of the member 200, an operator of the tool 100 attempting to depress the button 190 on the handle 120 to separate the handle 120 from the tool 100 will be prevented from doing so unless the member 200 is moved laterally (in a direction parallel to the line A shown in FIG. 6). When the member 200 is moved laterally a sufficient distance, the protrusion 188 of the movable member 182 no longer contacts the portion 202 of the member 200 upon rotation of the movable member 182. That is, the protrusion 188 may be rotated or moved into a cutout 204 provided adjacent the portion 202 of the member 200. Stated another way, lateral movement of the member 200 moves the portion 202 out of alignment with the protrusion 188 on the movable member 182 such that pivoting or rotation of the movable member 182 will not result in abutment or contact between the protrusion 188 and the portion 202 of the member 200. In this manner, the member 200 acts as a sort of safety lock to prevent unintentional disengagement of the handle 120 from the power tool 100.

Figure 6:
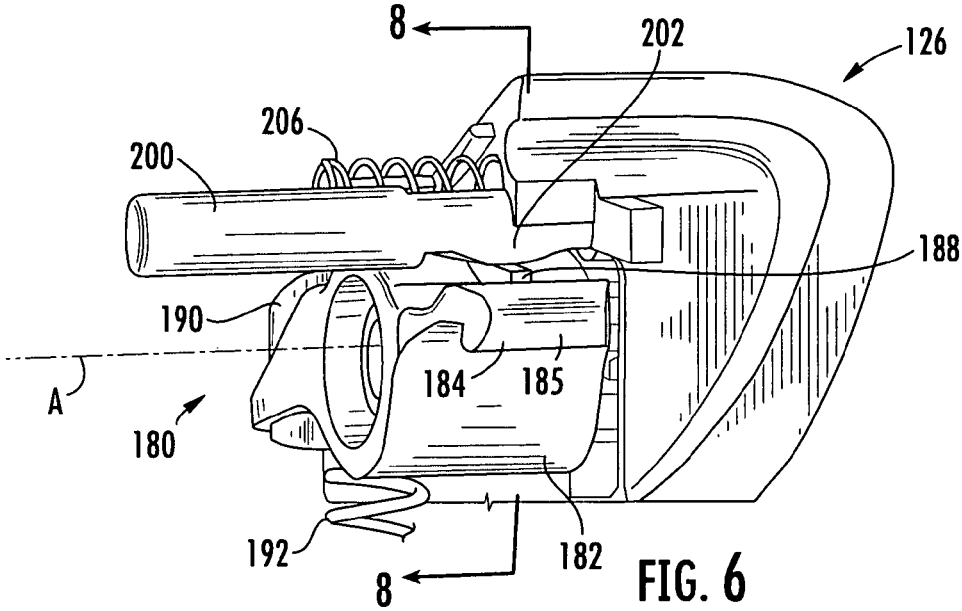
FIG. 6 is a partial cutaway perspective view of a portion of the detachable handle shown in FIG. 3 illustrating a handle attachment mechanism according to an exemplary embodiment in a locked position.
Figure 8:
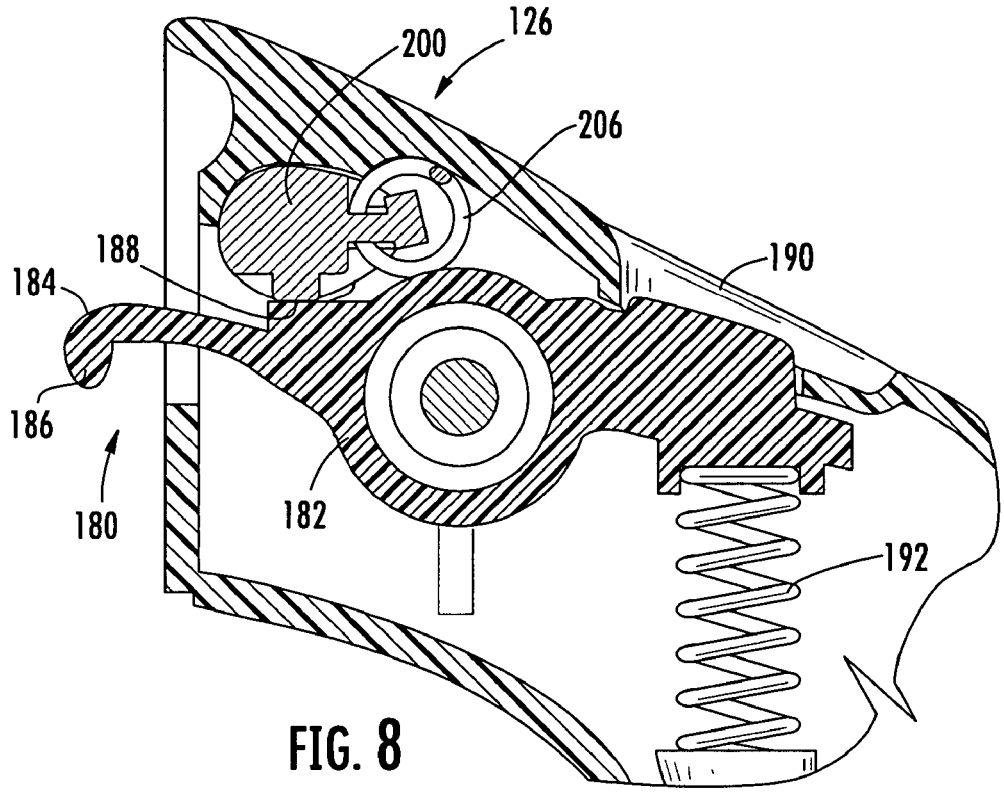
FIG. 8 is a cross-sectional view of the portion of the detachable handle shown in FIG. 6 taken across line 8-8 illustrating the handle attachment mechanism in the locked position.
Figure 9:
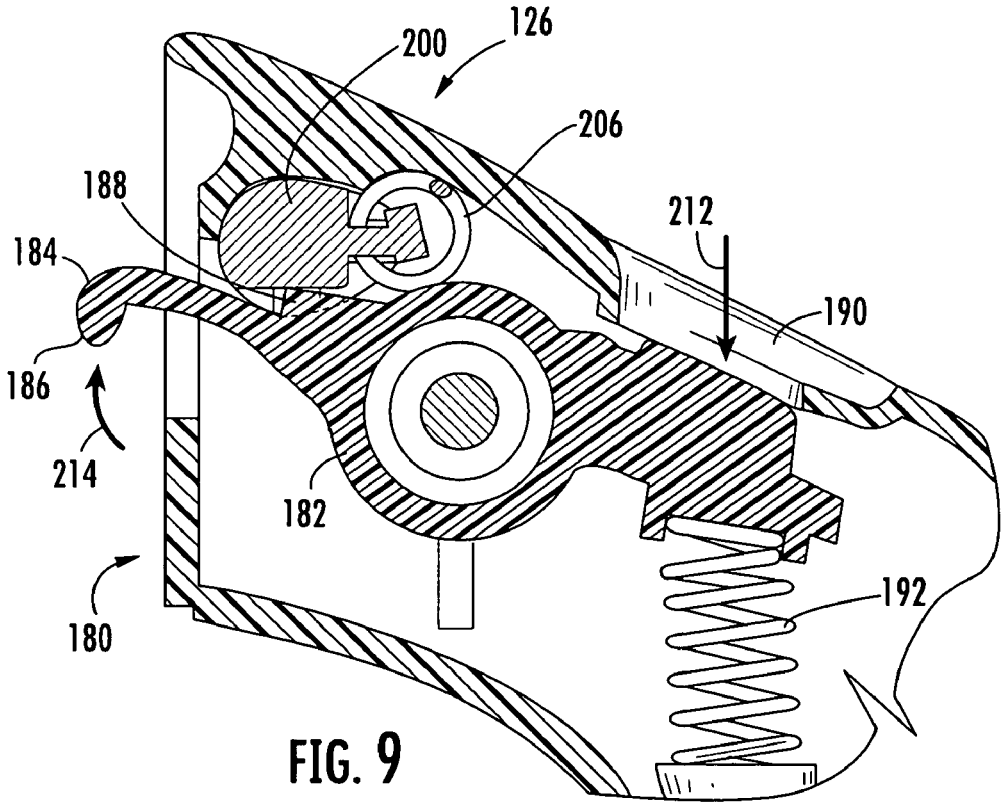
FIG. 9 is a cross-sectional view of the portion of the detachable handle shown in FIG. 7 taken across line 9-9 illustrating the handle attachment mechanism in the unlocked position.

As shown in FIGS. 6 and 8, when the member 200 is in a first position (e.g., the "rest" position), movement of the movable member 182 results in contact between the protrusion 188 and the portion 202 of the member 200 such that movement (e.g., pivoting or rotating) of the movable member 182 is restricted or prevented. To allow free movement of the movable member 182 (and hence, disengagement of the end 184 of the movable member 182 from the housing 110 of the tool 100), the member 200 is moved laterally (illustrated by an arrow 210 in FIG. 7) to move the portion 202 of the member 200 out of alignment with the protrusion 188 on the movable member 182. As shown in FIGS. 7 and 9, by first sliding the member 200 as illustrated by the arrow 210, depression of the button 190 (as illustrated by the arrow 212) causes rotation of the movable member 182 (as shown by the arrow 214) to allow the end 184 of the movable member 182 to disengage the housing 110 of the tool 100.

The following method may, therefore, be employed to relatively easily, quickly, and securely attach the handle 120 to the housing 110 of the tool 100, and to relatively easily and quickly remove the handle 120 from the housing 110. The handle 120 is positioned such that the member 170 (i.e., the fixed member) extending from the first end 124 of the handle 120 is aligned with an aperture formed in the housing 110. The handle 120 is tilted backward slightly, and the end of the member 170 is inserted into the apertures such that the end of the member 170 engages the housing 110 or a feature provided therein.

With the member 170 hooked into the aperture, the second end 126 of the handle 120 is brought forward toward a second aperture formed in the housing 110. As the second end 126 of the handle 120 is brought toward the housing 110, the end 184 of the movable member 182 engages the housing to secure the handle 120 to the tool 100. According to an exemplary embodiment, the surface 185 of the end 184 of the movable member 182 has a curvature that acts as a cam to allow smooth engagement of the movable member 182 with the housing 110 of the tool 100 without the need to actuate the member 182 by depressing the button 190 (e.g., the second end 126 of the handle "snaps" into place to couple the handle 120 to the tool 100). The feature 186 of the movable member 182 then acts to secure the handle 120 to the tool 100 by engaging the housing 110 or a feature provided therein. With the handle in this position attached to the housing 110, depression of the button 190 without movement of the member 200 will not result in movement of the movable member 182 to a degree which would allow detachment of the movable member 182 from the housing 110. The mechanism 180 thus acts to prevent unintentional disengagement of the handle 120 from the tool 100 (e.g., during use) according to an exemplary embodiment.

To remove the handle 120 from the housing 110, the member 200 is moved laterally prior to pushing the button 190. Lateral movement of the member 200 results in movement of the portion 202 of the member 200 that would normally prevent movement of the movable member 182 due to contact of the protrusion 188 with the portion 202. Because the portion 202 is not aligned with the protrusion 188 when the member 200 is moved laterally relative to the handle 120, the movable member 182 may be pivoted or rotated (e.g., about line A as shown in FIG. 7) to allow the end 184 of the movable member 182 to disengage the housing 110 of the tool 100. With the end 184 of the movable member 182 rotated away from the housing 110, the second end 126 of the handle may be detached from the housing 110, followed by the removal of the first end 124 of the handle 120 from the tool 100. In this manner, the handle 120 may be relatively easily and quickly removed from the housing 110 without need for any special tools.

It should be noted that the mechanism 180 illustrated in FIGS. 3 through 9 is exemplary only, and other mechanisms performing similar functions may be substituted therefor. For example, rather than providing a movable member (e.g., shown as movable member 182) that pivots, a movable member may be provided which is operable to move into and out of an aperture formed in a housing of a power tool along a substantially linear path. For example, the movable member may be configured such that a trigger provided in the handle may act to retract the movable member from an aperture. In such an embodiment, a member such as member 200 may be provided which restricts the retraction of the movable member in a first position and allows retraction of the movable member in a second position. According to another exemplary embodiment, the movable member does not include a protrusion (e.g., such as the protrusion 188 shown in FIGS. 6 and 7), but rather is configured such that a surface of the movable member will abut or contact a portion of a member such as the member 200 to prevent movement of the movable member. Various other configurations may also be used according to various other exemplary embodiments in which two movable members are provided in a detachable handle, one of which includes a feature for restricting the movement of the other of the movable members to prevent unintentional disengagement of the handle from the power tool.

Figure 4:
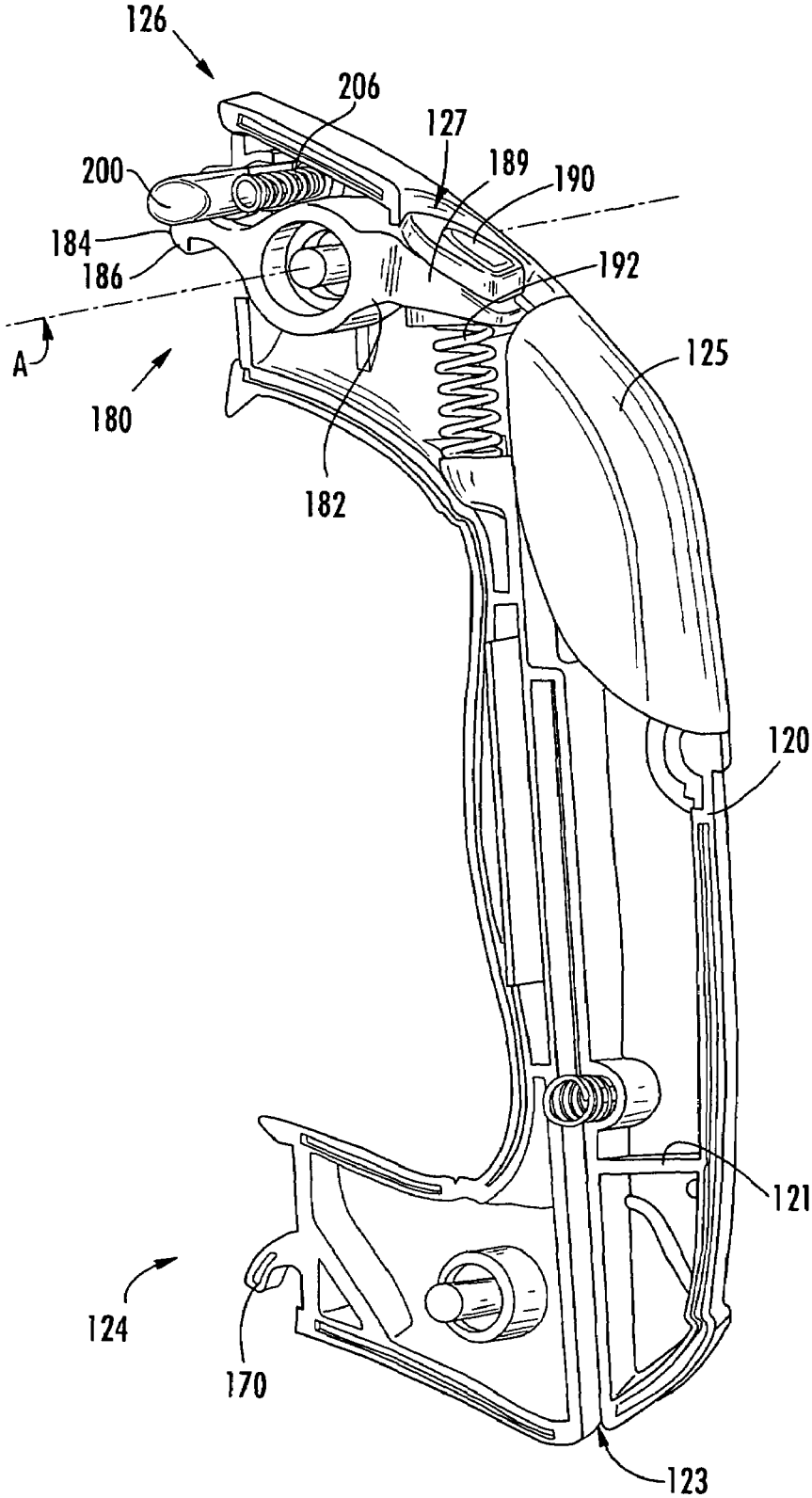
FIG. 4 is a partial cutaway view of the detachable handle shown in FIG. 3.
Figure 5:
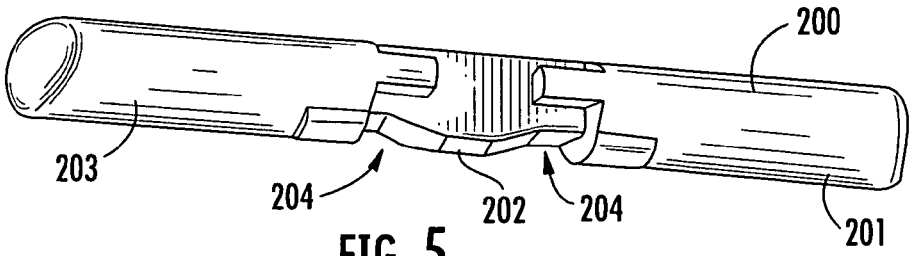
FIG. 5 is a perspective view of a member or element in the form of a pin or rod used in the detachable handle shown in FIG. 3 according to an exemplary embodiment.

As shown in FIG. 4, the handle 120 may be formed as two complementary and/or symmetric halves by a conventional molding process. The two halves are then joined together to form the complete handle 120. The two handle halves may be joined together in a conventional manner, for example, using an adhesive. The two handle halves may also be secured together using screws or another type of fastener.

As illustrated in FIG. 4, the handle 120 is substantially hollow, but includes molded internal structural elements 121 which provide strength and rigidity to the handle 120. The internal structural elements 121 of the handle 120 give the handle 120 the strength and rigidity of a solid handle, without requiring the amount of material required to form a solid handle, and with the light weight of a substantially hollow handle. Minimizing the weight of the handle 120 in this manner helps to minimize the fatigue experienced by an operator using the tool 100 with the handle 120 in place.

The structural elements 121 of the detachable handle 120 not only provide strength and rigidity to the handle 120, but also form hollow compartments or chambers within the handle 120. Compartments formed by the structural elements 121 of the handle 120 may be positioned so as to be employed for convenient storage locations. For example, as illustrated in FIG. 4, a slot 123 may be provided for storing a wrench or other tool for tightening the collet nut 152. One or more storage compartments may also be provided for storing tool bits and other items. As shown in FIG. 4, a compartment door 125 (e.g., a hinged door) may be provided to cover the compartment. Conventional latching tabs may be formed, e.g., on the inside of the door 125, to engage the inside of the detachable handle 120 to maintain the door 125 in a closed position when a tool 100 to which the handle 120 is attached is in operation. It should be noted that various storage compartments of different sizes and shapes than those described may be incorporated into the handle 120. Also, various types of doors or other covers may be used to close off or access the compartments.

It is important to note that the construction and arrangement of the power tool and detachable handle as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A power tool having a handle removably mounted to the power tool, the handle comprising:

a first member connected to the handle and configured to selectively engage a housing of a power tool; and a second member provided adjacent the first member and movable between a first position and a second position;

a spring adapted to bias the second member such that the second member is centered laterally within the handle when in the first position such that a first end of the second member protrudes a first distance away from an exterior surface of the handle and a second opposed end of the second member protrudes a second distance away from the exterior surface, the second distance substantially equal to the first distance;

wherein a first portion of the second member restricts movement of the first member when the second member is in the first position; and wherein a second portion of the second member does not restrict movement of the first member when the second member is in the second position such that the first member may be moved to disengage the power tool housing.

2. The power tool of claim 1, wherein the handle may be detached from the power tool housing when the second member is in the second position but may not be detached from the power tool housing when the second member is in the first position.

3. The power tool of claim 2, wherein the second member is accessible from opposite sides of the handle when the second member is in the first position.

4. The power tool of claim 1, wherein the second member is a pin configured for sliding movement relative to the first member.

5. The power tool of claim 1, wherein a first end of the first member is configured to engage the power tool housing and the first member may be moved by applying a force to a second end of the first member.

6. The power tool of claim 5, wherein the first member is retractably mounted in the handle.

7. The power tool of claim 1, wherein the first member comprises a protrusion that abuts the second member to prevent movement of the first member when the second member is in the first position.

8. The power tool of claim 1, wherein the first member and second member are provided at a first end of the handle and further comprising a fixed member extending from a second end of the handle for engaging the power tool housing.

9. The power tool of claim 1, wherein the handle comprises at least one storage compartment.

10. The power tool of claim 1, wherein the handle is configured for selective coupling to a rotary cutting tool.

11. A power tool having a detachable handle removably mounted to the power tool comprising:

a mechanism connected to the handle for selectively attaching the handle to a housing of the power tool, the mechanism comprising a first movable member and a second movable member;

wherein the first movable member is configured to engage a portion of the housing of the power tool when the handle is coupled to the power tool;

wherein the second movable member prevents disengagement of the first movable member from the housing of the power tool when the second movable member is in a first position and allows disengagement of the first movable member from the housing of the power tool when the second movable member is moved to a second position; and wherein a portion of the second movable member is provided within the handle and two ends of the second movable member extend outside of the handle such that the second movable member can be actuated for movement from the first position to the second position from opposite sides of the handle by pressing one of the ends of the second movable member.

12. The power tool of claim 11, wherein the second movable member is a pin biased toward the first position.

13. The power tool of claim 11, wherein the first movable member is retractably mounted in the handle.

14. The power tool of claim 11, wherein a portion of the first movable member contacts the second movable member to prevent movement of the first movable member when the second movable member is in the first position.

15. The power tool of claim 11, wherein the first movable member and second movable member are provided at a first end of the handle and further comprising a fixed member extending from a second end of the handle.

16. The power tool of claim 11, wherein the at least one of the first movable member and the second movable member comprise a metal material.

17. The power tool of claim 11, wherein the handle comprises at least one storage compartment.

18. The power tool of claim 11, wherein the handle is configured for selective coupling to a rotary cutting tool.

19. A power tool having a detachable handle removably mounted to the power tool comprising:

a mechanism connected to the handle for selectively attaching the handle to a housing of the power tool, the mechanism comprising a first movable member and a second movable member;

wherein the first movable member is configured to engage a portion of the housing of the power tool when the handle is coupled to the power tool;

wherein the second movable member prevents disengagement of the first movable member from the housing of the power tool when the second movable member is in a first position and allows disengagement of the first movable member from the housing of the power tool when the second movable member is moved to a second position;

a spring adapted to bias the second movable member to the first position; and wherein the second movable member is adapted to be actuated for movement from the first position to the second position from opposite sides of the handle when in the first position.

20. The power tool of claim 19, wherein the second movable member is a pin.

21. The power tool of claim 19, wherein the first movable member is retractably mounted in the handle.

22. The power tool of claim 19, wherein a portion of the first movable member contacts the second movable member to prevent movement of the first movable member when the second movable member is in the first position.

23. The power tool of claim 19, wherein the first movable member and second movable member are provided at a first end of the handle and further comprising a fixed member extending from a second end of the handle.

24. The power tool of claim 19, wherein at least one of the first movable member and the second movable member comprise a metal material.

25. The power tool of claim 19, wherein the handle comprises at least one storage compartment.

26. The power tool of claim 19, wherein the handle is configured it selective coupling to a rotary cutting tool.

* * * * *

UNITED STATES PATENT AND TRADEMARK OFFICE

CERTIFICATE OF CORRECTION

PATENT NO. : 7,424,768 B2
APPLICATION NO. : 11/228083
DATED : September 16, 2008
INVENTOR(S) : Michael Beruscha et al.

It is certified that error appears in the above-identified patent and that said Letters Patent is hereby corrected as shown below:

Column 10, line 54 claim 26, after "configured" please replace "it" with --for--.

Signed and Sealed this

Eleventh Day of November, 2008

JON W. DUDAS
*Director of the United States Patent and Trademark Office*